United States Patent [19]

Lockhart et al.

[11] 4,376,322

[45] Mar. 15, 1983

[54] SUCTION CLEANER

[75] Inventors: Scott N. Lockhart, Normal; Samuel E. Hohulin, Lexington, both of Ill.; Joseph F. Brooks, deceased, late of Bloomington, Ill., by Elva M. Brooks, executrix

[73] Assignee: National Union Electric Corporation, Greenwich, Conn.

[21] Appl. No.: 190,702

[22] Filed: Sep. 25, 1980

Related U.S. Application Data

[63] Continuation of Ser. No. 77,545, Sep. 21, 1979, abandoned, which is a continuation of Ser. No. 870,994, Jan. 20, 1978, abandoned.

[51] Int. Cl.[3] ..... A47L 9/00

[52] U.S. Cl. ..... 15/323; 15/334; 15/351

[58] Field of Search ..... 15/323, 331, 333, 334, 15/335, 350, 351

[56] References Cited

U.S. PATENT DOCUMENTS

| | | | |
|---|---|---|---|
| 1,936,761 | 11/1933 | Hoover | 15/334 |
| 1,953,944 | 4/1934 | Becker | 15/323 X |
| 2,175,642 | 10/1939 | Replogle | 15/334 |
| 2,867,833 | 1/1959 | Duff | 15/350 X |
| 3,879,797 | 4/1975 | Principe et al. | 15/334 |

FOREIGN PATENT DOCUMENTS

| | | | |
|---|---|---|---|
| 1208457 | 1/1966 | Fed. Rep. of Germany | 15/334 |

*Primary Examiner*—Chris K. Moore

*Attorney, Agent, or Firm*—Merriam, Marshall & Bicknell

[57] ABSTRACT

A suction cleaner capable of rapid conversion for either on-the-floor or above-the-floor cleaning, is disclosed. The cleaner includes an elongated housing arranged in a generally upright manner and having an elongated, upwardly extending handle at the rear side thereof. A floor nozzle is connected to the lower end of the housing so that the latter "floats" on the surface of a rug or carpet being cleaned. A suction control valve assembly is mounted in a cavity in the rear of the housing so as to be easily removable therefrom. The valve assembly is connected to conduit means extending between a subatmospheric pressure filtering chamber in the housing and the floor nozzle. An auxiliary suction inlet communicates with the filtering chamber, upstream from the suction valve assembly, and one end of an auxiliary suction hose is permanently connected to the auxiliary inlet. The valve of the suction control valve assembly shifts from a position establishing communication between the floor nozzle and the filtering chamber when the cleaner housing is inclined rearwardly for on-the-floor cleaning and to a position preventing communication between the floor nozzle and the filtering chamber when the cleaner housing is in an upright position for above-the-floor cleaning. A recess is provided in the rear side of the handle to receive and releasably retain the suction hose when the latter is not in use and another cavity is provided between the housing and handle to receive an above-the-floor cleaning tool when this tool is not in use. The major components of the cleaner are compactly arranged so that the overall bulk of the cleaner is reduced.

34 Claims, 21 Drawing Figures

61
189
197
176
60
190
30
194
32a
177
37
32
178
173
116
183
117
118
35
193
40
173
122
19
19
172
33
39
123
124
107
38
126
103
106
105
108
127
36
104
100
130
147
142
137
34
68
109
148
32b
50
75
145
48
50
47
173
180
67
62
64
181

178
190
191

190
177
191
178
21
21
192
173

SUCTION CLEANER

This is a continuation of application Ser. No. 77,545, filed Sept. 21, 1979, now abandoned, which is a continuation of application Ser. No. 870,994, filed Jan. 20, 1978, now abandoned.

This invention relates to suction cleaners, and more particularly relates to a suction cleaner capable of either on-the-floor or above-the-floor cleaning and in which provision is made for conveniently storing an auxiliary suction hose in a recess in the handle of the cleaner and an above-the-floor cleaning tool in a cavity defined by the housing of the cleaner.

Many suction cleaners heretofore developed and presently available are capable of both on-the-floor or above-the-floor cleaning. Such convertible cleaners usually employ a suction generating fan and some form of valve for controlling the application of suction developed by the fan either to a floor nozzle or to an auxiliary suction inlet in the housing of the cleaner to which one end of a flexible suction hose is attached. The opposite end of a hose is usually adapted to receive different types of tools suited for above-the-floor cleaning.

While the suction control valves utilized in so-called convertible cleaners were generally capable of performing their intended function, some have not proved to be entirely satisfactory for various reasons. One of such reasons is that, because the suction control valves were permanently mounted in the housings of the cleaners and in inaccessible locations, they were difficult to inspect, clean, adjust or replace. Another reason is that, due to the complexity of the linkage employed to actuate the control valves in a number of the convertible cleaners heretofore advanced, such valves were of marginal reliability.

In addition to the aforementioned problems, many of the convertible suction cleaners heretofore advanced were objectionable from the standpoint that considerable time and effort was required to convert the cleaner from operation as an on-the-floor cleaner to an above-the-floor cleaner, and vice versa. One of the reasons for this was that the auxiliary suction hose utilized on some of the cleaners was detached from the cleaner when not in use and oftentimes stored in a location remote from the cleaner.

In order to solve this problem, provision was made in some cleaners for storing the suction hose in a recess in the handle used to manipulate the cleaner when the latter was functioning in an on-the-floor cleaning mode. Such cleaners usually had one end of the suction hose permanently connected to an auxiliary suction inlet in the housing of the cleaner.

While cleaners of the latter type eliminated the inconvenience of transporting the suction hose used for above-the-floor cleaning from a remote location and connecting the hose to the auxiliary section inlet, such cleaners are oftentimes cumbersome to use and store because of the construction of the handle of the cleaner and the manner in which the suction hose was retained therein when not in use.

Accordingly, it is a general object of the present invention to provide a novel and improved suction cleaner, which is free of the aforementioned disadvantages and objections.

Another object is to provide a novel suction cleaner, which may be rapidly and easily converted for operation either as an on-the-floor or above-the-floor cleaner.

A further object is to provide a novel suction control valve assembly for a convertible suction cleaner of the foregoing character, which is accessible and easily removable from the cleaner for purposes of inspection, cleaning or replacement.

Still another object is to provide a novel handle construction for a convertible suction cleaner of the character described, whlrein a recess is provided in the handle for receiving and storing the suction hose associated with above-the-floor cleaning so that the hose is at all times readily available for use.

A further object is to provide a novel suction cleaner of the foregoing character, wherein an elongated cavity is provided on the cleaner for receiving and storing an accessory cleaning tool adapted to facilitate above-the-floor cleaning so that the tool is at all times available for use.

A still further object is to provide a novel suction cleaner in which the major components of the cleaner are arranged in a compact manner so as to improve the handling and storage characteristics of the cleaner.

Other objects and advantages of the invention will become apparent from the following detailed description and accompaying sheets of drawings, in which.

Briefly described, the present invention contemplates a novel suction cleaner capable of being easily converted for either on-the-floor or above-the-floor cleaning. The cleaner includes an elongated housing, arranged in a generally upright manner, and having elongated, upwardly extending handle means secured at the rear of the housing for manipulating the cleaner over a rug or carpet when the latter is functioning as an on-the-floor cleaner. Suction generating means is mounted in the housing for generating reduced pressure in a filtering chamber in the housing so that dirt and other particles are drawn into and retained in a replaceable filter bag mounted in the filtering chamber.

Floor nozzle means, including a nozzle body having an inlet in the underside thereof, is carried at the lower end of the housing and connected thereto so as to "float" on the upper surface of a rug or carpet being cleaned when the cleaner is functioning in an on-the-floor cleaning mode. The housing also includes an auxiliary suction inlet connected by passage means in the housing with the filtering chamber.

Conversion of the cleaner for operation either as an on-the-floor or above-the-floor cleaner is facilitated by a novel suction control valve assembly, which is removably mounted in a cavity in the rear of the cleaner housing and which is operatively connected to conduit means connecting the suction inlet in the floor nozzle with the filtering chamber. The valve assembly includes a plate-like valve member, which is movable to a position permitting communication between the filtering chamber and the floor nozzle inlet and auxiliary inlet, and a position preventing communication between the filtering chamber and the floor nozzle inlet. The valve member is actuated by an elongated member that is shiftably mounted in the cleaner housing. The upper end of the elongated member engages a can surface on an actuating member connected to the valve member and the lower end of the elongated member engages a surface on the nozzle body.

One end of a length of flexible suction hose is connected to the auxiliary suction inlet, and a recess is provided in the rear side of the handle of the cleaner for receiving and retaining the hose in a collapsed, unobtrusive position when the cleaner is functioning in an on-the-floor cleaning mode. Retention of the hose in the handle recess is enhanced by magnetic means in the handle, which coacts with magnetic material in the hose when the latter is in its stored position.

The rear wall of the housing is formed so as to define a longitudinally extending cavity for receiving and storing an elongated, tubular cleaning tool, such as a wand, when the latter is not in use. One end of the tool is insertable into a hand nozzle on the free end of the suction hose to facilitate cleaning of elevated area above the floor.

Figure 1:
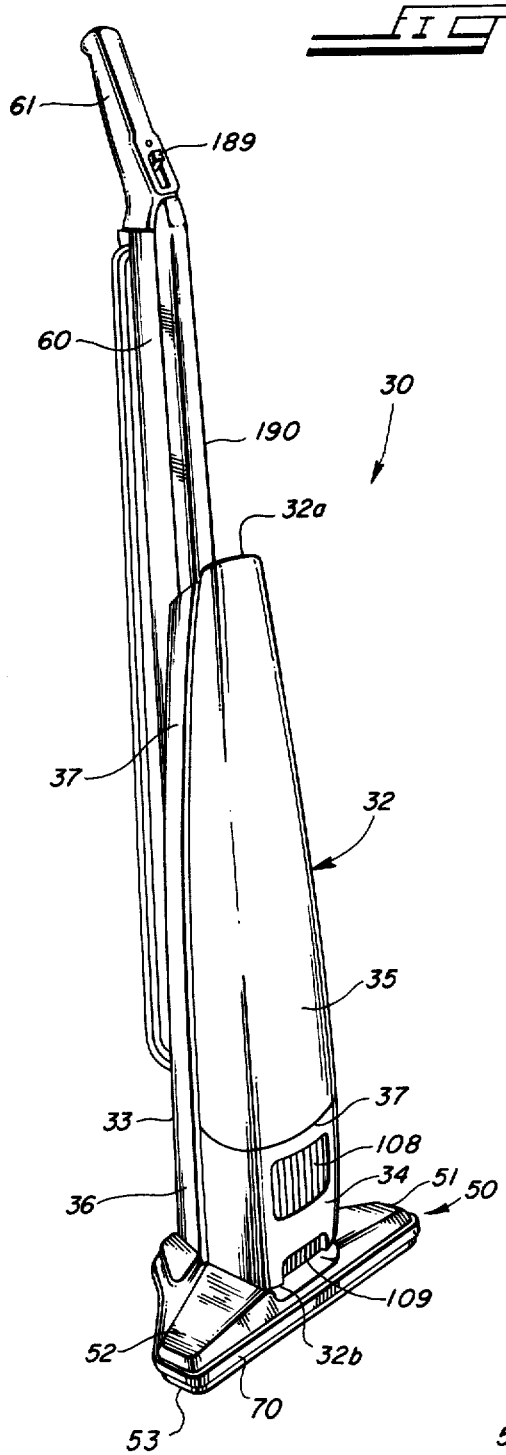
FIG. 1 is a perspective view of aa suction cleaner embodying the features of the present invention.
Figure 2:
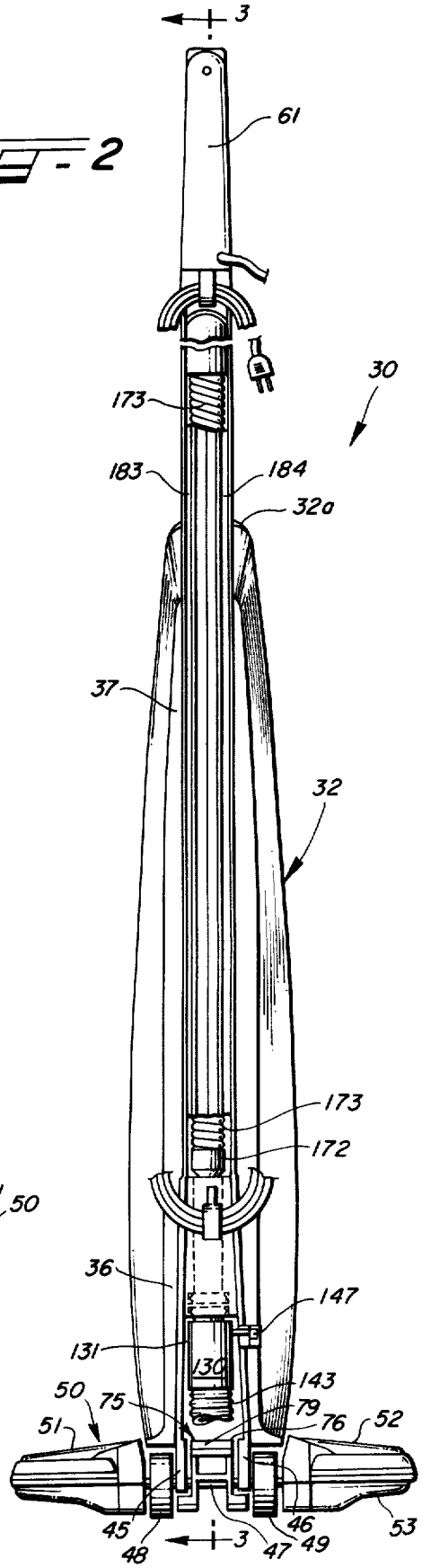
FIG. 2 is a rear elevational view, with some parts broken away to show underlying structure, of the suction cleaner illustrated in FIG. 1.
Figure 3:
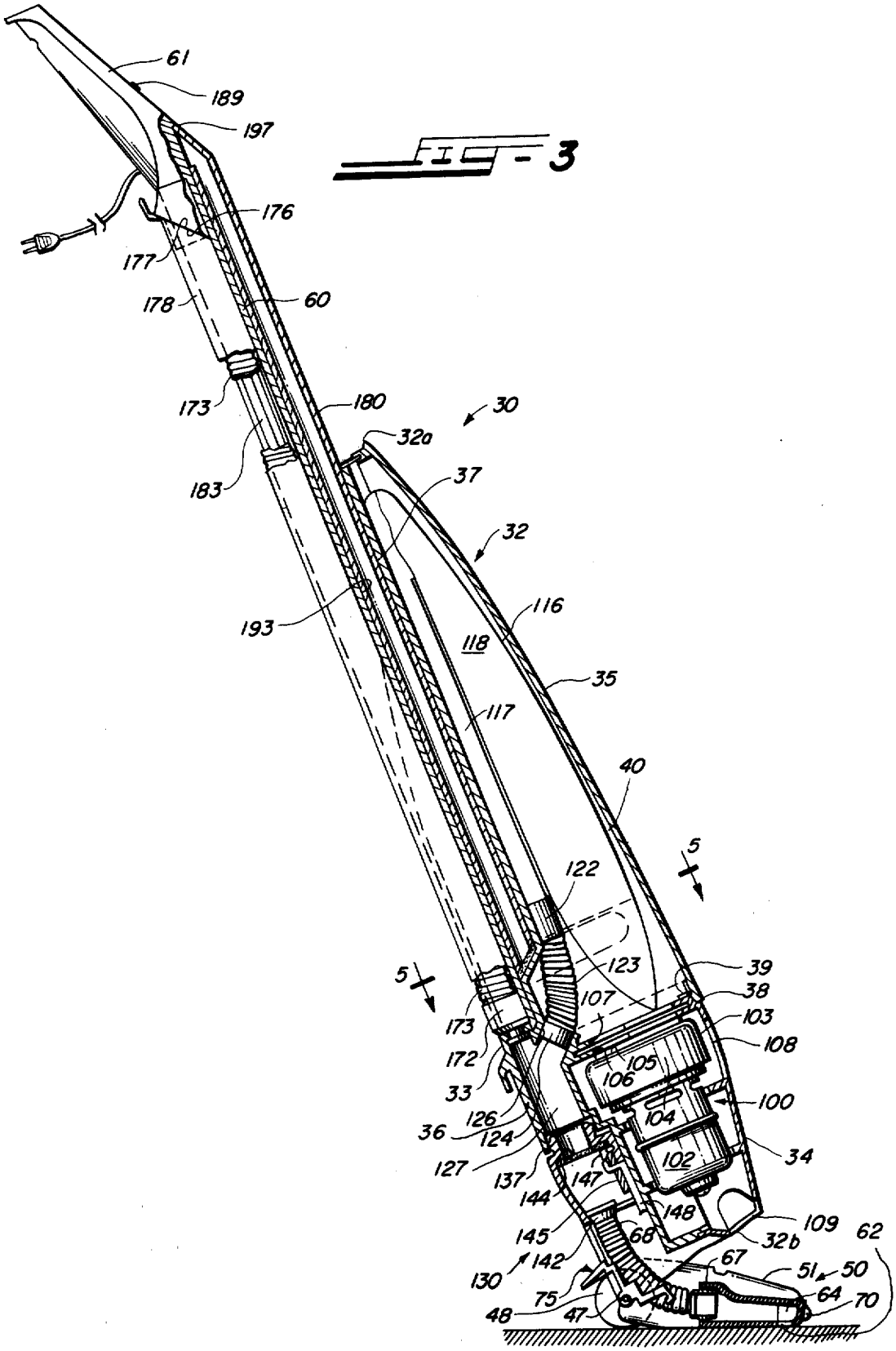
FIG. 3 is a longitudinal sectional view, taken substantially along the line 3—3 of FIG. 2 but with some parts in section and other broken away to show additional structural details, of the suction cleaner illustrated in FIGS. 1 and 2 when the latter is functioning in an on-the-floor cleaning mode.
Figure 4:
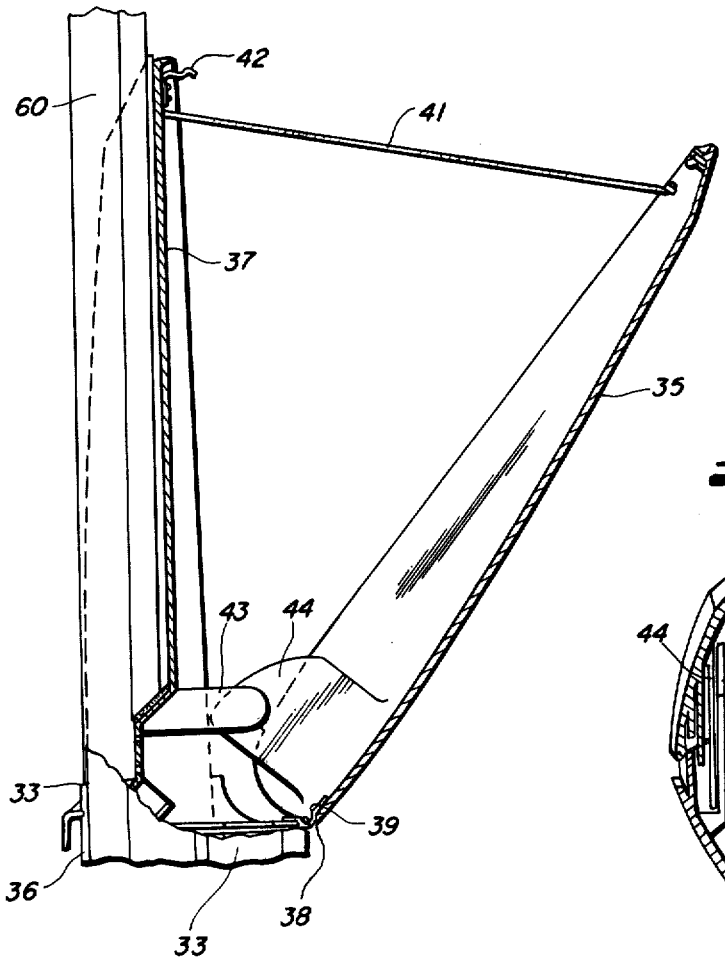
FIG. 4 is a longitudinal sectional view, with some parts in section and with others removed for clarity, of the upper portion of the housing of the cleaner shown in FIGS. 1-3, inclusive, and showing the front section of the housing swung to an open position to permit removal and/or installation of a replaceable filter bag.

Referring initially to FIGS. 1–4, inclusive, a suction cleaner embodying the features of the present invention is illustrated and indicated generally at 30. The cleaner 30 generally comprises an elongated housing 32 arranged in a generally upright position and having an upper end 32*a* and a lower end 32*b*. The housing 32 is preferably formed in three sections, namely, a rear section 33, a lower front section 34 and an upper front section 35. As best seen in FIGS. 1, 2 and 3, the rear section 33 includes a lower part 36 and an upper part 37. The front section 35 is hingedly connected at its lower front edge 38 to the upper forward edge of the lower front section 34, as by a hinge assembly 39 (FIGS. 3 and 4). The front housing section 35 and upper rear housing part 37 define a filtering chamber 40 in the housing 32 when the front section 35 and rear housing part 37 are engaged. Access to the interior of the filtering chamber 40 is obtained by pivoting the front section 35 away from the housing part 37, such movement being limited by restraining means in the form of a length of cord 41 (FIG. 4). A retainer clip 42 prevents unintentional movement of the housing section 35 away from the housing part 37.

Figure 5:
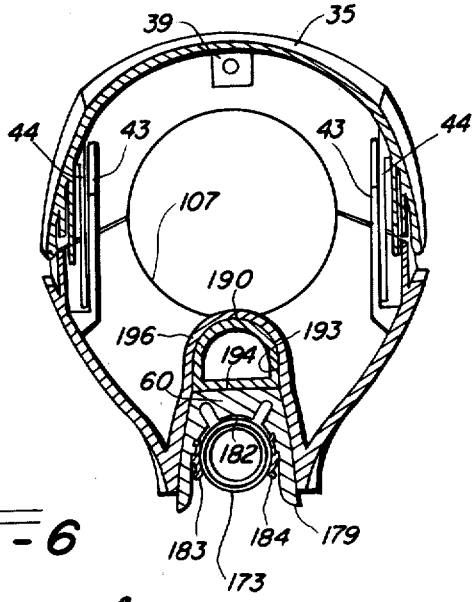
FIG. 5 is a transverse sectional view, with some parts in section and other parts removed for clarity of presentation, taken substantially along the line 5—5 of FIG. 3.

A pair of laterally spaced, forwardly extending flanges 43 (FIGS. 4 and 5) are provided on the housing part 37 and a pair of laterally spaced, rearwardly extending flanges 44 are provided on the housing section 35. The pairs of flanges 43 and 44 are arranged in closely spaced side-by-side relation, as shown in FIG. 5, and are of a length so that portions of the flanges at all times overlap each other throughout the range of relative movement between the housing section 35 and housing part 37. The flanges 43 and 44 prevent lateral displacement of the front housing section 35 and possible damage to the hinge assembly 39 when the housing section 35 is in its forward limit position shown in FIG. 4.

The lower end of the rear housing part 36 terminates in a pair of laterally spaced flanges 45 and 46 (FIGS. 2 and 6) through which a shaft 47 extends. A pair of wheels 48 and 49 are rotatably mounted on the shaft 47, the wheels being rotatable but otherwise fixed with respect to the housing 32.

Figure 6:
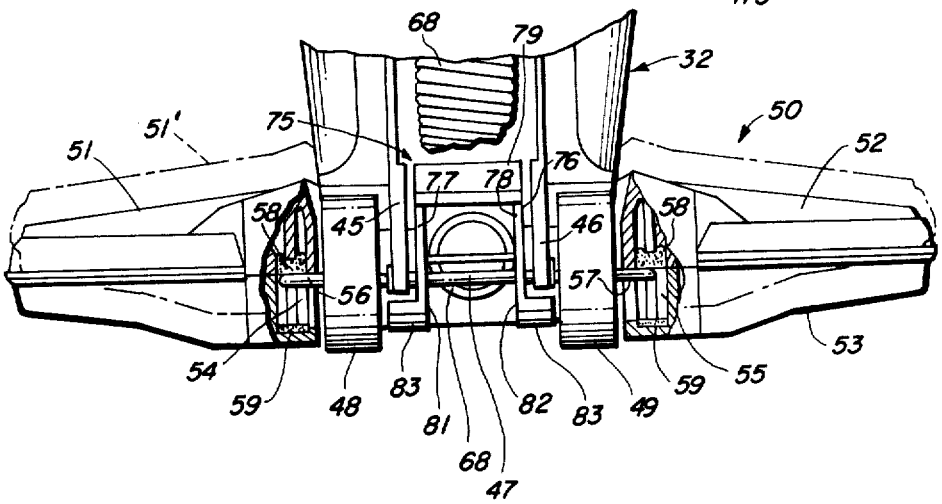
FIG. 6 is an enlarged rear elevational view, with some parts in section and some parts in phantom, of the floor nozzle and a portion of the lower end of the housing of the suction cleaner illustrated in FIG. 2 and showing the position of the parts when the cleaner is functioning in an on-the-floor cleaning mode.

Floor nozzle means, which is indicated generally at 50 in FIGS. 1–3 and 5–7, inclusive, and which includes a nozzle body 51, is connected to the lower end 32*b* of the housing 32 by a lost motion connection which permits the nozzle body 51 to "float" on the surface of a rug or carpet being cleaned when the cleaner 30 is functioning in an on-the-floor cleaning mode. The nozzle body 51 is generally trapezoidally-shaped in plan and includes an upper section 52 and a lower section 53. A pair of vertically extending slots or guideways 54 and 55 (FIG. 6) are formed in the nozzle body 51 for receiving the ends 56 and 57 of the shaft 47. The guideways 54 and 55 are of a length sufficient to accommodate a substantial amount of relative movement between the body 51 and the ends 56 and 57 of the shaft 47 and thus between the nozzle body 51 and housing 32 of the cleaner. In FIG. 6, the approximate range of movement of the nozzle body 51 relative to the housing 32 is represented in full and broken lines, the broken line position being indicated at 51'. Pads 58 and 59, of nylon or some other suitable wear resistant and cushioning material, may be provided at the upper and lower ends of the guideways 54 and 55.

The aforementioned lost motion connection between the housing 32 and nozzle body 51 is described in greater detail and claimed in the Joseph F. Brooks and Robert B. Meyer U.S. Pat. No. 3,815,170, which issued on June 11, 1974 and which is assigned to the assignee of this application.

Figure 7:
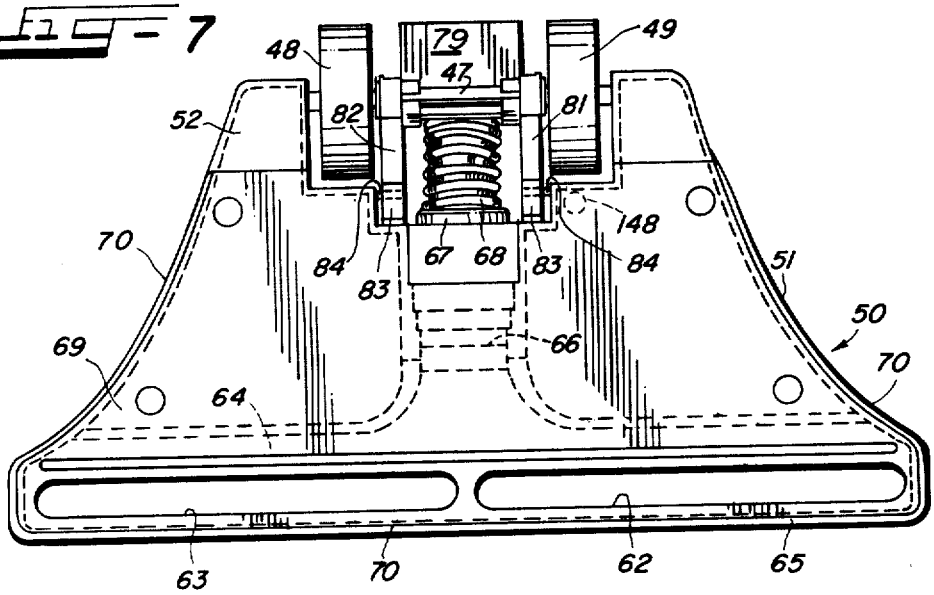
FIG. 7 is a bottom plan view of the suction nozzle of the cleaner and showing the arrangement and location of the inlet ports in the suction nozzle of the cleaner.

As best seen in FIG. 7, a pair of laterally extending, elongated openings or slots 62 and 63 are provided in the undersurface of the nozzle body 51 and adjacent to the front edge, indicated at 65, of the body. The openings 62 and 63 comprise a suction inlet for the floor nozzle 50 and communicate with a suction chamber 64 and a connecting central passage 66 in the nozzle body 51. The passage 66 communicates with a fitting 67 connected to one end of a length of flexible hose 68 and through other passages and conduit means, to be hereinafter described, with the filtering chamber 40. The filtering chamber 40, which comprises a zone of reduced pressure in the housing 32 when the cleaner is operating, is maintained at subatmospheric pressure by suction generating means in the form of a motor-fan unit 100, also to be hereinafter described. A sole plate 69 may be provided on the underside of the lower section 52 of the nozzle body 51 and a furniture guard or bumper 70 may be provided on the forward and rearwardly converging side edges of the body. Handle means in the form of an elongated, upstanding handle 60 located at the rear of the housing 32 and having a grip 61 at the upper end thereof, is provided for manipulating the cleaner 30 over a rug or carpet being cleaned.

In order to releasably retain the housing 32 in a substantially upright position, as illustrated in FIGS. 1 and 2, when the cleaner 30 is inoperative or functioning in its above-the-floor cleaning mode, releasable latch means, indicated generally at 75, is provided for this purpose. The latch means 76 comprises a generally inverted, U-shaped latch member 76 (FIG. 6) having a pair of laterally spaced, vertically extending legs 77 and 78 which are connected at their upper ends by an integral treadle portion 79. The treadle portion 79 extends rearwardly from the upper ends of the legs 77 and 78 for access by the foot of a user of the cleaner.

The legs 77 and 78 of the latch 76 include forwardly extending extensions 81 and 82 (FIGS. 6–9), the outer ends of which are provided with hooks 83 for engaging laterally extending abutments or pins 84 (FIG. 7) on the lower section 52 of the nozzle body 51 to prevent relative rocking movement between the nozzle body 51 and cleaner housing 32. There is sufficient clearance between the bearing openings, indicated at 86 in FIGS. 8 and 9, and the journal of the shaft 47 to permit the hooks 83 to shift relative to and disengage the pins 84 when the latch 76 is pivoted downwardly and rearwardly by the user's foot. The disengaged position of the latch 76 is shown in broken lines in FIG. 8 and indicated at 76'.

Figure 9:
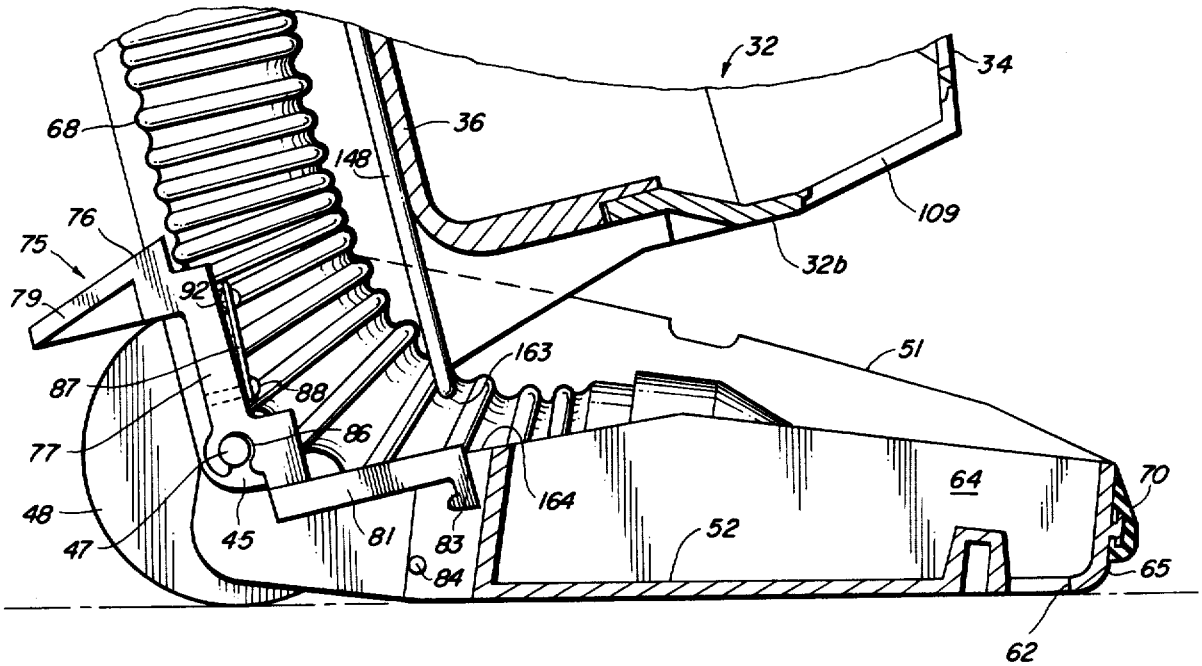
FIG. 9 is a view similar to FIG. 8 but showing the parts of the cleaner as they would appear when the cleaner is operative and functioning in an on-the-floor cleaning mode.
Figure 8:
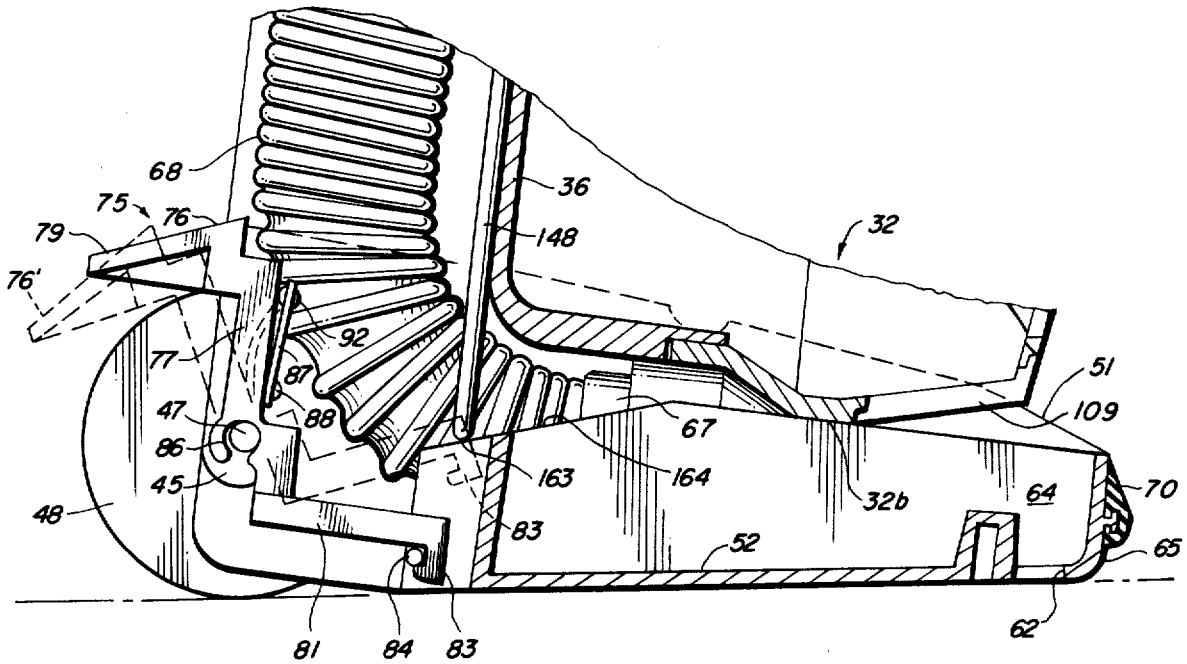
FIG. 8 is an enlarged sectional view of the floor nozzle and a portion of the lower end of the housing of the cleaner illustrated in FIG. 3.

The latch 76 is biased toward its latching position illustrated in full lines in FIG. 8 by spring means in the form of a pair of leaf springs, only one of which is illustrated in FIGS. 8 and 9 and indicated at 87. The lower ends of the leaf springs 87 are secured, as by rivets 88, to their respective latch legs 77 and 78 and the upper ends of the springs 87 are secured to laterally outwardly extending pins 92 mounted in the flanges 45 and 46 of the housing 32.

As heretofore mentioned, the cleaner 30 includes suction generating means, in the form of the motor-fan unit 100, for reducing the pressure in the filtering chamber 40 to a subatmospheric level so as to cause air to be drawn into the suction inlet openings 62 and 63 in the nozzle body 51 when the cleaner is operating in an on-the-floor cleaning mode. The motor-fan unit 100 (FIG. 3) is preferably mounted in the front section 34 of the cleaner housing 32 and includes an electric motor 102 and a fan assembly 103. The fan assembly 103 includes a housing 104 having an axial inlet (not shown) in the upper end wall 105 thereof and an annular, axial, outlet (also not shown) at the lower end thereof. The inlet of the fan assembly 104 communicates with the filtering chamber 40 through a pair of aligned openings 106 and 107 in the upper end wall of the cleaner housing section 34. A more detailed description of the construction and operation of the motor-fan unit 100 will be found in the Raymond G. Kroker and Richard E. Kronmiller U.S. Pat. No. 3,263,908, which issued on Aug. 2, 1966 and which is assigned to the assignee of this application.

Exhaust air from the fan assembly 103 discharges to the atmosphere through a grillwork 108 in the front face of the housing section 34. Another series of slots, indicated at 109 in FIGS. 1 and 3 is provided in the bottom wall of the housing section 34, the slots 109 serving as a secondary cooling air inlet for the motor 102. An auxiliary cooling inlet (not shown) is provided in the lower end wall of the motor 102 for receiving cooling air from the slots 109.

Figure 10:
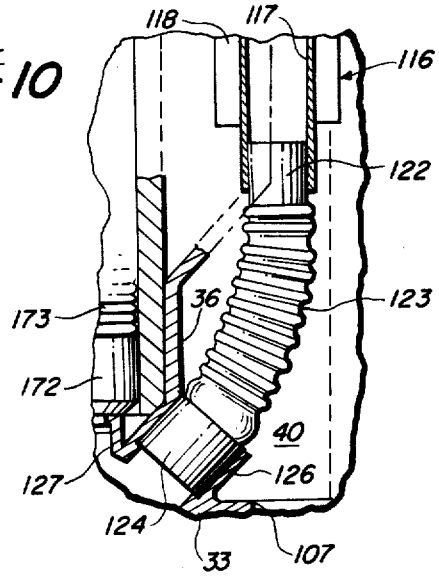
FIG. 10 is a fragmentary vertical sectional view, with some parts in elevation, showing the flexible connection between the passages in the cleaner housing and the lower end of the delivery tube of the replaceable filter bag of the cleaner.

Filtering means in the form of a filter bag assembly 116 is mounted in the filtering chamber 40, the filter bag assembly 116 including an elongated delivery tube 117, which extends upwardly along the rear side of the main portion, indicated at 118, of the assembly 116 and communicates with the interior of the main portion 118 through an opening (not shown) at the upper end thereof. The lower end of the delivery tube 117 is connected to the upper end, indicated at 122 in FIGS. 3 and 10 of a length of flexible hose 123. The lower end, indicated at 124, of the hose 123 extends into an annular boss 126 in the rear housing section 36, the boss 126 communicating with a generally axially extending passage 127 in the rear housing part 36. The suction chamber 64 and passages 66 in the floor nozzle 51, together with the hoses 68 and 123 comprise conduit means connecting the suction inlets 62 and 63 in the floor nozzle with the filtering chamber 40 and the suction generating means or fan assembly 104.

According to the present invention, the cleaner 30 includes valve means, indicated generally at 130 in FIGS. 2, 3 and 11–14, inclusive, for controlling communication between the filtering chamber 40 and the suction inlets 62 and 63 in the nozzle body 51 to render the floor nozzle operative or inoperative. The valve means 130 includes a generally rectangular housing or body 132 having laterally spaced side walls 133 and 134 (FIG. 13), a front or inner wall 135 and a rear or outer wall 136. The housing or body 132 is removably mounted in a cavity 131 (FIGS. 2 and 11) in the rear of the cleaner housing 32 and also includes a tubular extension 137, which preferably extends upwardly from the upper end wall, indicated at 138, of the housing. The tubular extension 137 is provided with a pair of annular, radially outwardly extending ribs 139, which frictionally engage a counterbore 140 at the lower end of the passage 127 in the housing section 36. To this end, the extension 137 as well as the housing 132 are preferably of a resilient and wear resistant material, such as polyvinyl chloride.

The lower end, indicated at 139, of the housing 130 terminates in a circular opening 141 and an annular fitting 142 on the upper end of the flexible hose 68 is mounted in the opening 141. Thus, the valve housing or body 132 may be removed from the cavity 131 for purposes of inspection, cleaning or replacement by shifting the latter downwardly until the extension 137 is disengaged from the counterbore 140. The hose 68 is removed with the valve body 132.

Figure 11:
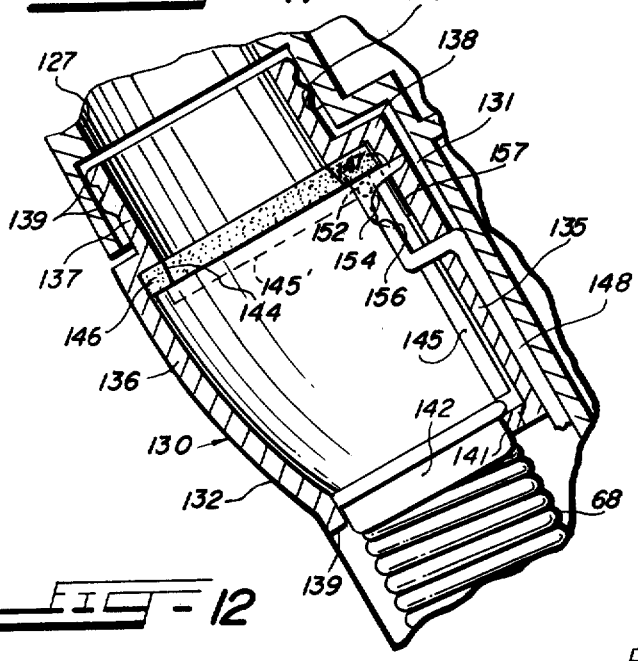
FIG. 11 is a fragmentary longitudinal sectional view, with some parts in elevation, of the suction control valve assembly of the cleaner, the former embodying the features of the present invention.
Figure 12:
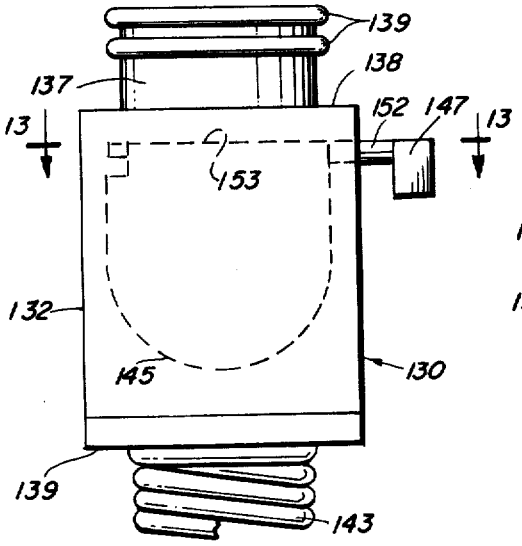
FIG. 12 is a rear elevational view of the valve assembly illustrated in FIG. 11.
Figure 17:
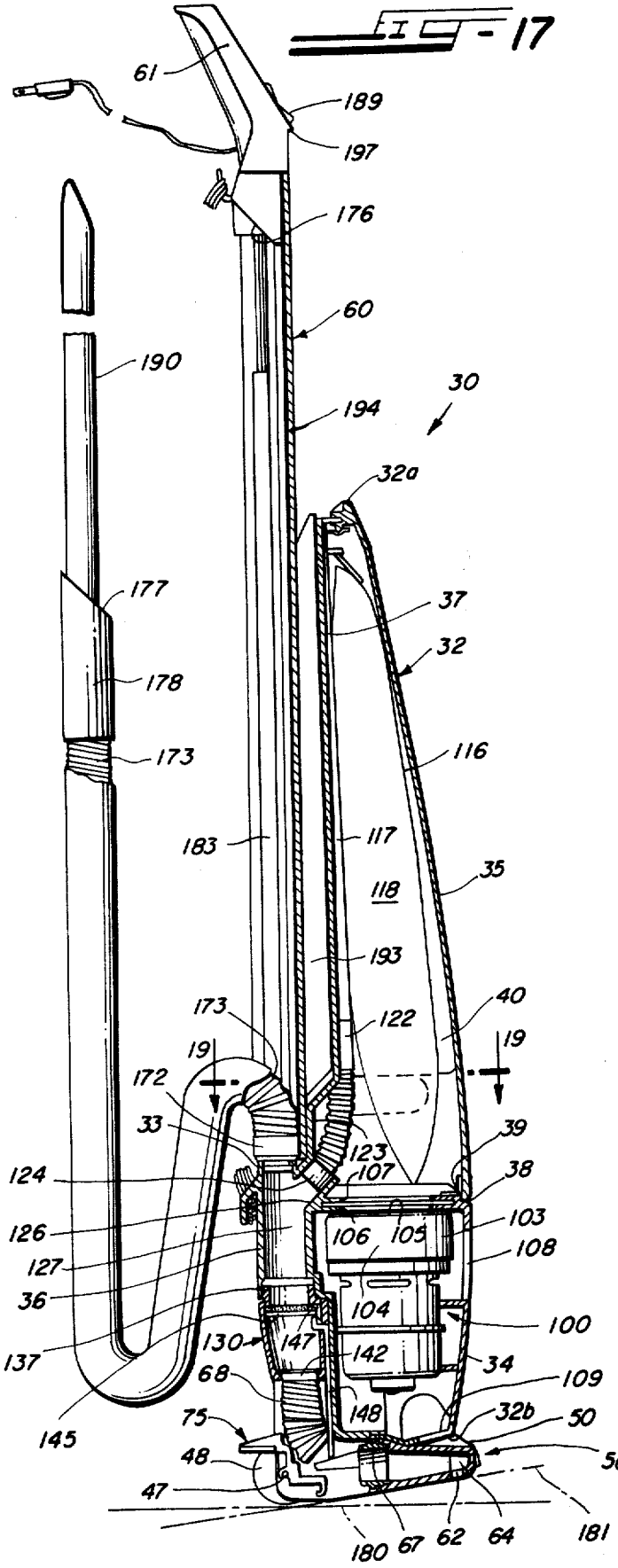
FIG. 17 is a longitudinal sectional view, with some parts in elevation, of the suction cleaner of the present invention when set up for above-the-floor cleaning.

A plate-like, valve member 145, which is also preferably of vinyl and having a generally semicircular configuration, is positioned in the housing 132 and mounted for pivotal movement therein between an open position in which the valve member 145 lies generally adjacent to the inner side of the inner wall 135, as illustrated in FIGS. 3, and 11–13, inclusive, and a closed position in which the valve member 145 extends transversely across the interior of the housing 132, as shown by the broken line position of the valve member and indicated at 145' in FIG. 11 and the full line position of the valve member 145 in FIG. 17. In order to prevent any leakage around the valve member 145, a gasket 146 of foam rubber, or the like, and having a central opening 144 therein, is mounted on the underside of the upper end wall 138 of the valve housing 132 to provide a substantially air-tight seal between the engaged surface of the valve member 145 and the gasket 146.

Movement of the valve member 145 between its operative and inoperative positions is effected by means responsive to the movement of the housing 32 of the cleaner between its upright position illustrated in FIGS. 1 and 2 and its rearwardly inclined position illustrated in FIG. 3. Such means preferably comprises an actuating member 147 connected to the valve member 145, and an elongated member in the form of a push rod 148 mounted in the rear housing section 33. The actuating member 147 is preferably formed integrally with a shaft 152, which is also preferably formed integrally with the valve member 145. The shaft 152 is coextensive with a linear edge 153 of the valve member.

Figure 13:
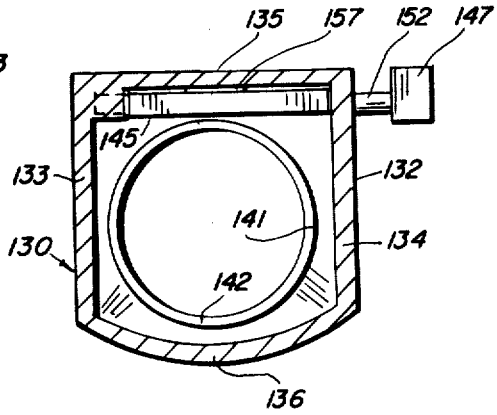
FIG. 13 is a cross sectional view, taken substantially along the line 13—13 of FIG. 12.
Figure 14:
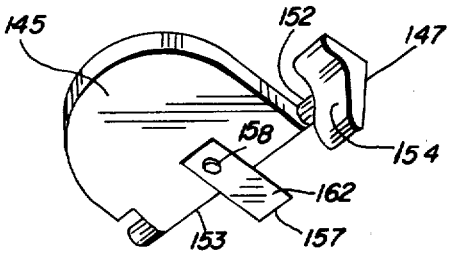
FIG. 14 is a perspective view of the swingable valve member of the valve assembly illustrated in FIGS. 11–13 inclusive.

As best seen in FIGS. 11 and 14, the actuating member 147 has a concave cam surface 154 which coacts with the upper end, indicated at 156, of the push rod 148 to effect pivotal movement of the actuating member 147 and hence of the valve member 145 from its open position illustrated in full lines in FIG. 11 to its closed position illustrated in broken lines in this figure and indicated at 145'. The valve member 145 is normally biased to its full line, open position illustrated in FIGS. 3 and 11 by spring means in the form of a leaf spring 157 secured as by a rivet 158 (FIG. 14) to the underside of the valve member, the free end, indicated at 162, of the leaf spring engaging the inner surface of the front or inner wall 135 of the valve housing 132, as shown in FIGS. 11 and 13.

Figure 16:
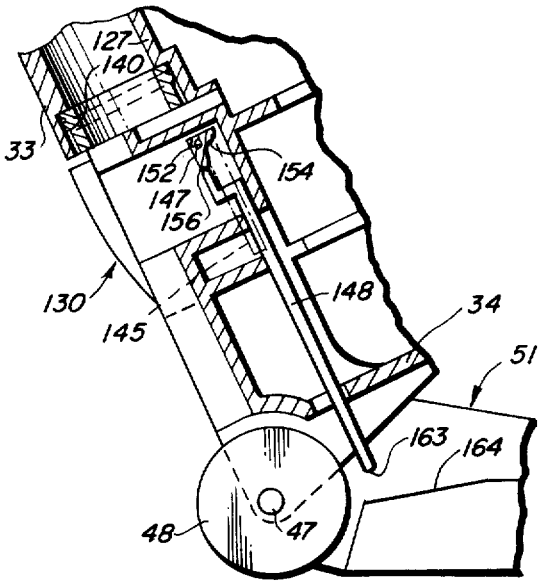
FIG. 16 is a fragmentary sectional view taken substantially along the line 16—16 of FIG. 15.
Figure 15:
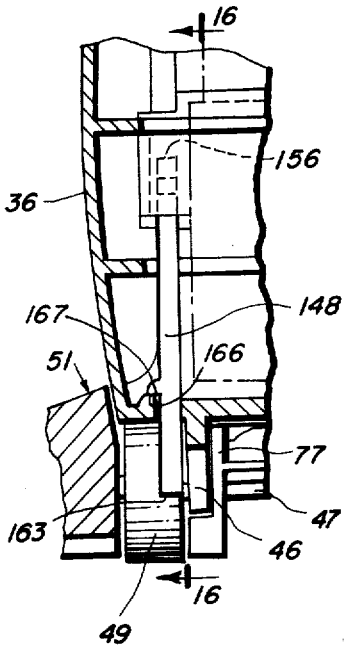
FIG. 15 is a fragmentary vertical sectional view, with some parts in elevation, showing additional details of the structure for operating the suction control valve of the cleaner.

Upward movement of the push rod 148 to cause the upper end 156 of the push rod to engage the cam surface 154 and swing the valve member 145 to its closed position occurs when the lower end, indicated at 163 in FIGS. 8, 9 and 16, of the push rod engages a surface 164 on the nozzle body 51. The length of the push rod 148 is such that the lower end 163 thereof contacts the surface 164 shortly before the housing 32 reaches a substantially upright position. In order to prevent the push rod 148 from being in continuous contact with the surface 164 when the housing 32 of the cleaner is in a rearwardly inclined position, such as when the cleaner is being used for on-the-floor cleaning, a stop in the form of a shoulder 166 (FIG. 15) may be formed on the push rod for engaging a ledge 167 formed on a lower wall of the housing section 34.

Figure 18:
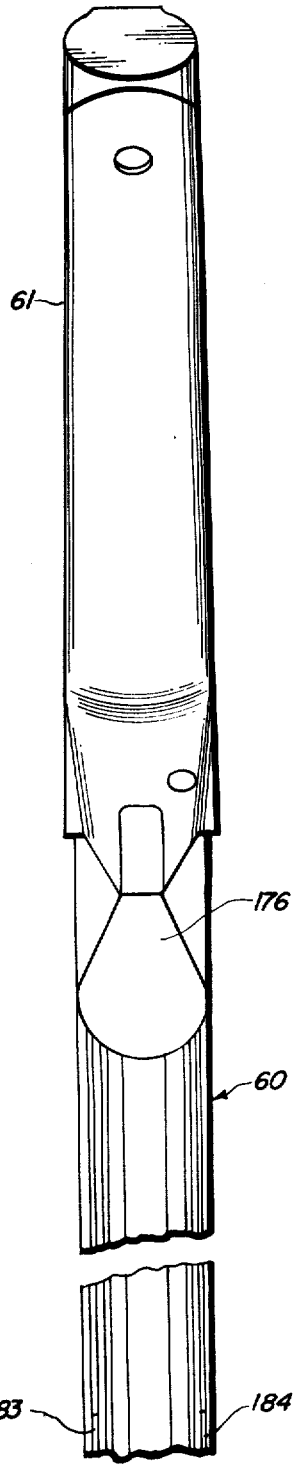
FIG. 18 is a fragmentary rear elevational view of the upper end of the handle of the cleaner as the latter would appear when the associated suction hose is disengaged from the handle.

As heretofore mentioned, the cleaner 30 is also adapted for above-the-floor cleaning. To this end, a fitting 172 on the lower end of an auxiliary suction hose 173 (FIGS. 2, 3 and 10 and 17) is connected to the upper end of the passage 127 in the housing section 36 so that vacuum in the filtering chamber 40 is also present in the hose 173 whenever the motor-fan unit 100 is operating. Consequently, in order to maintain the efficiency of the floor nozzle 51 when the cleaner is operating in an on-the-floor mode, loss of vacuum through the hose 173 must be prevented. To this end, a sealing surface, indicated at 176 in FIGS. 3, 17 and 18, is provided at the upper end of the handle 60 and a mating surface 177 is provided on the outer end of a tubular hand nozzle 178 secured to the upper end of the auxiliary suction hose 173. Thus, when the hand nozzle 178 is in its stored position engaged with the handle 60, in the manner illustrated in FIG. 3, little or no suction loss will occur between the engaged surfaces 176 and 177. Consequently, maximum vacuum will be available at the suction inlets 62 and 63 of the floor nozzle 51.

Preferably, the sealing surface 176 on the handle 60 is inclined with respect to the longitudinal axis of the handle and the mating surface 177 on the hand nozzle 178 is beveled to an angle such that, when the surface 177 is engaged with the surface 176, the axis of the hand nozzle 178 will be substantially parallel to the axis of the handle 60. This relationship is shown in FIG. 3.

According to the present invention, provision is made for storing the auxiliary suction hose 173 in a convenient location in the cleaner 30 so that the hose is always available for immediate use. To this end, the handle 60 is generally U-shaped in cross section throughout the major portion of its length and thus defines a recess 182 (FIGS. 5 and 18) therein that is generally semicircular in cross section and of a size such as to receive the auxiliary suction hose 173 in nested relation. The handle 60 is preferably oriented so that the recess 182 is located in the rear side, indicated at 179, of the handle. The hose fitting 172 is located at the lower end of the recess 182 to accommodate a suction hose of substantial extended length.

In order to improve retention of the hose 173 in the recess 182 when the cleaner is functioning in an on-the-floor cleaning mode, retaining means is provided for releasably retaining the hose in the recess. Such retaining means preferably comprises magnetic means in the form of at least one and preferably a pair of elongated strips of magnetic material 183 and 184 (FIGS. 17, 18 and 19) having portions 186 thereof disposed in elongated slots 187 (FIG. 19) in the opposed inner surfaces of the walls of the recess 182 and extending longitudinally of the handle 60.

Figure 19:
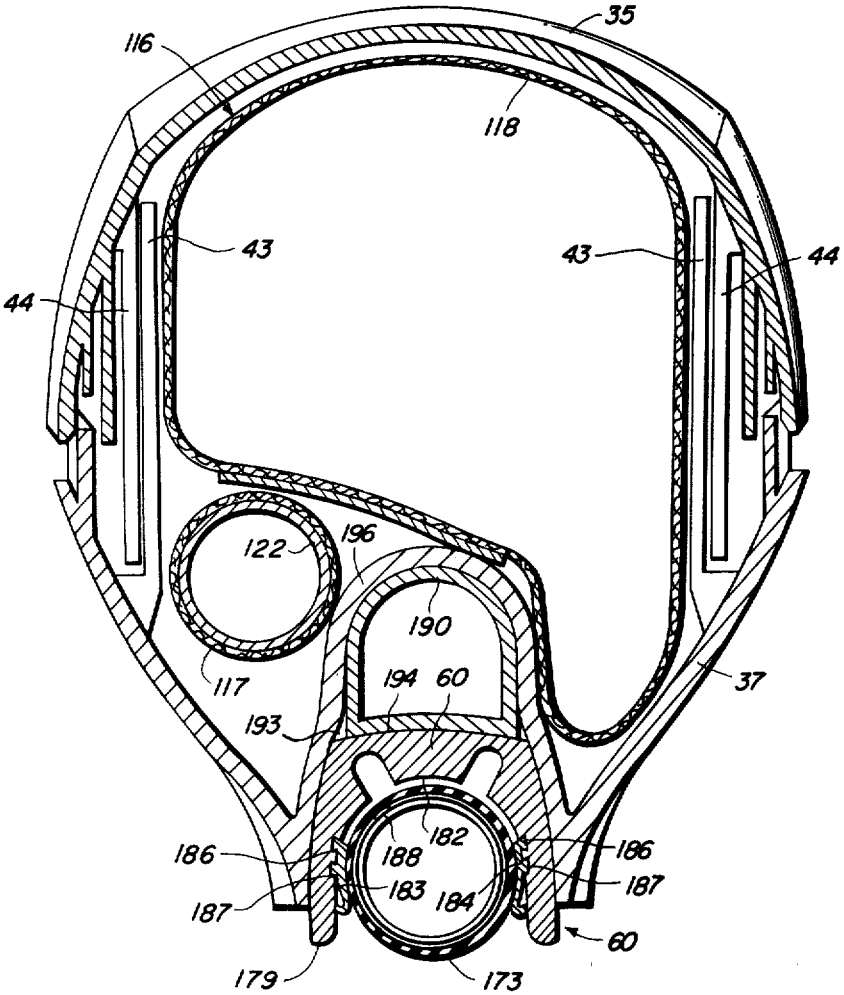
FIG. 19 is a transverse sectional view taken substantially along the line 19—19 of FIG. 17.

The magnetic material strips 183 and 184 extend for substantially the full length of the recess 182, as shown in FIGS. 2 and 17, and are adapted to coact with magnetic material in the hose 173 to retain the latter in the recess 182. In the present instance, the magnetic material in the hose 173 comprises the coils of a reinforcing wire 188 (FIG. 19). The strips 183 and 184 also serve to frictionally retain the hose 173 in the recess 182 since the lateral spacing between the inner surfaces of the strips 183 and 184 is substantially equal to and preferably slightly smaller than the outside diameter of the hose 173.

When the cleaner 30 is operating in an on-the-floor cleaning mode, the hose 173 is subjected to the suction force developed by the fan assembly 103. Consequently, the coils of the hose are maintained in a collapsed condition and a substantial force is generated tending to hold the mating surface 177 of the hand nozzle 178 engaged with the sealing surface 176 of the handle 60. This force also tends to hold the hand nozzle 178 and the hose 173 in the recess 182 because of the aforementioned angular relationship of the sealing and mating surfaces 176 and 177 and also because the axis of the hose fitting 172 is substantially coextensive with the recess 182.

As heretofore mentioned, the cleaner 30 is capable of operating in an above-the-floor cleaning mode. Thus, if the cleaner has previously been operating in an on-the-floor cleaning mode with the housing 32 and the handle 60 inclined rearwardly, as illustrated in FIG. 3, the cleaner may be readily converted for operation in an above-the-floor cleaning mode merely by tilting the handle 60, and hence the cleaner housing 32 toward its upright position illustrated in FIGS. 1, 2, and 17. As the handle 60 and housing 32 move toward an upright position, the lower end 163 of the push rod 148 engages the surface 164 of the nozzle body 51, as shown in FIG. 8, and shifts the push rod upwardly. Such movement causes the upper end 156 of the push rod 148 to engage the cam surface 154 of the actuating member 147 so that the valve member 145 is caused to swing to its closed position illustrated in broken lines at 145' in FIG. 11 and in full lines in FIG. 17.

Shortly before the handle 60 and the cleaner housing 32 reach their upright position, the hooks 83 (FIGS. 8 and 9) at the forward ends of the extensions 81 of the latch 76 extend over and interlock with the pins 84 of the nozzle body 51, as illustrated in FIG. 8. Consequently, the cleaner housing 32 and nozzle body 51 are locked against relative movement. When so interlocked, the housing 32 and handle 60 tip slightly forwardly, as shown in FIG. 8. The forward angle of inclination of the housing 32 and handle 60 with respect to the vertical is indicated by the included angle between the lines 180 and 181 in FIG. 17.

When the nozzle housing 51 and cleaner housing 32 are interlocked, as shown in FIGS. 8 and 17, the cleaner 30 may be easily transported to an area of use merely by tilting the handle 60 backwardly so as to raise the nozzle 51 and thus permit the cleaner to roll on the wheels 48 and 49.

Assuming that the cleaner 30 is in or has been moved to a location where it is to be used for above-the-floor cleaning, the operator need only grasp the hand nozzle 178 and withdraw the nozzle as well as the suction hose 173 from the retaining recess 182 in the rear of the handle 60. Thereafter, a control switch 189 on the handle grip 61 is shifted to a position to energize the motor 102 of the motor-fan unit 100 so that vacuum is generated in the chamber 40 and passage 127. However, since the valve 145 is in its closed position at this time, suction is prevented from being applied to the suction inlets 62 and 63 in the floor nozzle 51. Consequently, maximum suction is available at the outer end 177 of the hand nozzle 178.

Figure 21:
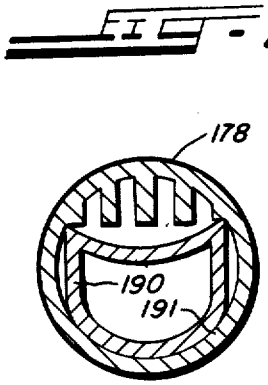
FIG. 21 is a sectional view taken along the line 21—21 of FIG. 20.
Figure 20:
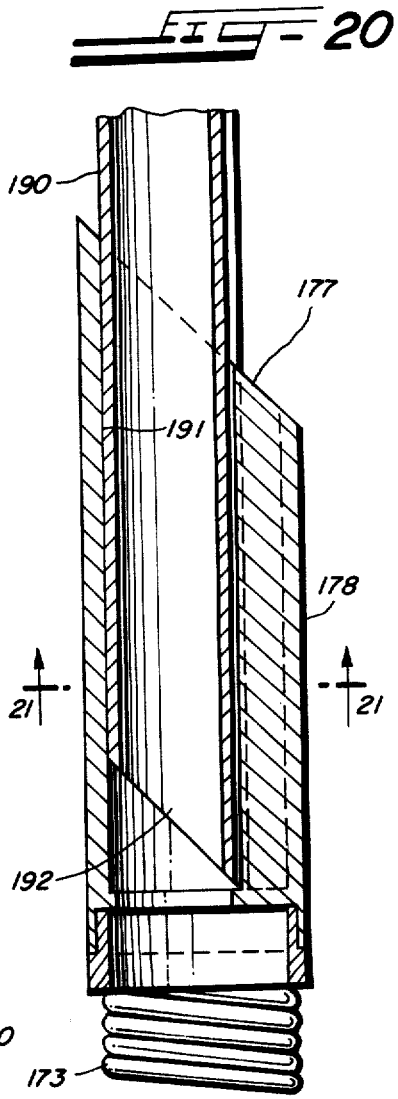
FIG. 20 is a full scale, longitudinal sectional view showing the engaged relationship of the lower end of an auxiliary, above-the-floor cleaning tool with an above-the-floor, hand nozzle at the distal end of the suction hose of the cleaner.

If the user of the cleaner should desire to clean an above-the-floor area located at a height or in a location which cannot be conveniently reached by the hand nozzle 178, the cleaner 30 includes an elongated, tubular member or wand 190 for this purpose. The wand 190 is preferably semi-circular in cross section, as shown in FIG. 21, and is sized to snugly fit portions of the interior, indicated at 191, of the hand nozzle 178. Thus, the proximal or lower end portion, indicated at 192, of the wand 190 is frictionally retained in the hand nozzle 178 after the portion 192 is inserted into the hand nozzle. When so engaged, the wand 190 functions as an extension of the hand nozzle 178.

When the cleaner 30 is functioning in an on-the-floor cleaning mode, as indicated in FIG. 3, or when the wand 190 is not in use, the wand is conveniently stored in an elongated cavity, indicated at 193 in FIGS. 5, 17 and 19, between the inner or front side, indicated at 194, of the handle 60 and a complementally-shaped portion 196 (FIGS. 5 and 19) formed by an inwardly displaced portion of the upper rear part 37 or the housing section 33. The inner or front side 194 of the handle 60 is preferably fromed with the same contour as the rear side of the wand 190. A lip 197 (FIGS. 3 and 17) on the grip 61 of the handle 60 engages the upper end of the wand 190 when the latter is positioned in its storage cavity 193 and releasably retains the wand in the cavity. Thus, the wand 190 is always conveniently available for use.

From the foregoing description, it will be appreciated that, because of the compact arrangement of the components of the cleaner, the overall size and bulk thereof is substantially reduced without loss of efficiency or cleaning capability. Such reduction in size is obtained by the provision of the recess 182 in the rear of the handle 60, which receives and stores the auxiliary suction hose 173 when the cleaner is operating in its on-the-floor cleaning mode or is inoperative, and the provision of the storage cavity 193 in the upper rear part 37 of the housing section 33, which provides a convenient storage area for the wand 190 when the cleaner is functioning in its on-the-floor cleaning mode or is inoperative. In addition, the location of the suction control valve assembly 130 in the cavity 130 in the lower rear part 36 of the housing section 33 greatly facilitates removal of the valve assembly for inspection, cleaning or replacement.

While only one embodiment of the invention has been herein illustrated and described, it will be understood that modifications and variations in the construction thereof may be effected without departing from the spirit of the invention, and its equivalents, as defined in the appended claims.

What is claimed is:

1. In a suction cleaner adapted for either on-the-floor or above-the-floor cleaning and including a housing having suction-generating means therein and floor nozzle means adapted to be moved over a rug or carpet to be cleaned, conduit means connecting said floor nozzle means with said suction-generating means, said housing also having an auxiliary inlet communicating with said suction-generating means, a suction hose having one end connected to said auxiliary inlet to permit above-the-floor cleaning, and elongated handle means connected to said housing for manipulating said floor nozzle means over a rug or carpet to be cleaned, the improvement of a recess in said handle means for receiving said hose, and retaining means including magnetic means adapted to coact with magnetically attractable material in said hose to exert a magnetic force on the magnetically attractable material in said hose and tending to hold said hose in nested relation in said recess when said hose is not in use.

2. The suction cleaner of claim 1, in which said recess extends lengthwise of said handle means.

3. The suction cleaner of claim 2, in which said handle means is disposed at the rear of said housing and said recess is located in the rear of said handle means.

4. The suction cleaner of claim 1, in which said magnetic material comprises a length of reinforcing wire.

5. The suction cleaner of claim 4 in which said hose is convoluted, and said reinforcing wire is coiled and positioned in the internal cavities of the convolutions of said hose.

6. In a suction cleaner capable of either on-the-floor or above-the-floor cleaning, said cleaner including a housing having a chamber therein, means for reducing the pressure in said chamber to a subatmospheric level, floor nozzle means connected to said housing and adapted to be moved over a rug or carpet to be cleaned, said floor nozzle means also having a suction inlet through which dirt and the like dislodged from a rug or carpet is drawn, conduit means connecting said floor nozzle means with said chamber, said housing also having an auxiliary suction inlet communicating with said chamber, a flexible hose having one end connected to said auxiliary inlet, the opposite end of said hose having hand nozzle means connected thereto, said hand nozzle means having an inoperative, stored position and an operative position wherein the hand nozzle means can be manipulated by a user into proximity with an above-the-floor area to be cleaned, and elongated handle means connected to said housing for manipulating said cleaner over a rug or carpet, said handle means being disposed in a substantially upright position when said cleaner is operating in an above-the-floor cleaning mode and in a rearwardly inclined position when said cleaner is operating in an on-the-floor cleaning mode, the improvement of suction control means for controlling communication between said chamber and said floor nozzle means, said suction control means comprising valve means in said conduit means, said valve means being movable between an open position establishing communication between said chamber and said floor nozzle means and a closed position preventing communication between said chamber and said floor nozzle means, means for effecting movement of said valve means to said closed position in response to movement of said handle means from said rearwardly inclined position to said substantially upright position, and means coacting with said hand nozzle means for preventing flow through the inlet of said hand nozzle means when said cleaner is operating and said hand nozzle means is in said inoperative stored position.

7. The suction cleaner of claim 6, in which said coacting means comprises a sealing surface on said handle means and a mating surface on said hand nozzle means.

8. The suction cleaner of claim 7, in which said sealing surface is provided at the upper end of said handle means and a mating surface is provided on the outer end of said hand nozzle means.

9. The suction cleaner of claim 8, in which said hand nozzle means comprises a tubular member having its inner end connected to said opposite end of said hose, the outer end of said tubular member is beveled so that said mating surface is inclined with respect to the axis of said tubular member, and said sealing surface on said handle means is inclined with respect to the longitudinal axis of said handle means so that the axis of said tubular member is substantially parallel to the axis of said handle means when said hand nozzle means is in its stored position with the mating surface on said tubular member engaged with the sealing surface on said handle means.

10. The suction cleaner of claim 6, in which said cleaner housing has upper and lower ends and is connected to and movable with said handle means, said floor nozzle means includes a nozzle body rockably carried at the lower end of said cleaner housing, and said means for effecting movement of said valve means to said closed position comprises an elongated member shiftably mounted in said cleaner housing, one end of said elongated member engages said nozzle body and the other end of said elongated member engages said valve means and causes movement thereof to said closed position as said cleaner housing and said handle means are moved from an inclined to said substantially upright position.

11. The suction cleaner of claim 10, in which said elongated member comprises a push rod.

12. The suction cleaner of claim 11, in which said valve means includes a housing having side and upper and lower end walls, each of said end walls having an opening therein respectively connected to adjacent ends of said conduit means, a valve member is mounted in said housing for movement between said open and closed positions, and said valve member has an actuating member connected thereto and adapted to be engaged by said other end of said elongated member.

13. The suction cleaner of claim 12, in which said actuating member has a cam surface thereon, and said other end of said elongated member engages said cam surface and effects movement of said valve member to said closed position as said cleaner housing and said handle means move to said substantially upright position.

14. The suction cleaner of claim 13, in which said valve member has a flat side edge and a shaft portion extending laterally outwardly from said side edge and through one of the side walls of said casing, and said actuating member is mounted on the end of said shaft portion.

15. The suction cleaner of claim 12, in which said valve means includes spring means biasing said valve member toward its open position.

16. The suction cleaner of claim 15, in which said valve member is of a generally plate-life form, and said spring means comprises a leaf spring secured to one side of said valve member so that a portion thereof projects beyond the side edge of said valve member, said projecting portion of said leaf spring engaging the inner surface of a wall of said casing.

17. In a suction cleaner including a housing having suction-generating means therein, floor nozzle means connected to said housing and adapted to be moved over a rug or carpet to be cleaned, means for generating a zone of reduced pressure in said housing, conduit means connecting said floor nozzle means with said reduced pressure zone, said housing also having an auxiliary inlet communicating with said reduced pressure zone and having one end of a suction hose connected thereto, the opposite end of said suction hose having hand nozzle means connected thereto for cleaning above-the-floor areas, the improvement of a suction control valve assembly connected to said conduit means and operable to establish or prevent communication between said reduced pressure zone and said floor nozzle means, said cleaner housing having a cavity therein, and said suction control valve assembly including a valve body removably mounted in said cavity, whereby said valve assembly can be removed from said housing for inspection, cleaning or replacement.

18. The suction cleaner or of claim 17, in which said valve body has laterally spaced side and end walls, at least one of said end walls has a tubular extension, said cleaner housing has a passage therein connected to said conduit means, and said tubular extension extends into one end of said passage.

19. The suction cleaner of claim 18, in which said tubular extension is frictionally retained in said end of said passage.

20. The suction cleaner of claim 19, in which said cavity is elongated and extends generally vertically in said housing, said valve body has upper and lower end walls, and said tubular extension is provided on the upper end wall of said valve body.

21. The suction cleaner of claim 20, in which at least said tubular extension is of a resilient material, whereby said extension is deformable to permit disengagement thereof from said end of said passage and removal of said valve body from said cavity.

22. The suction cleaner of claim 21, in which at least said tubular extension is of vinyl.

23. The suction cleaner of claim 22, in which said valve body has a valve member mounted therein for movement between positions establishing and preventing communication between said reduced pressure zone and said floor nozzle means, and said valve body and valve member are of vinyl.

24. A suction cleaner comprising an elongated housing arranged in a generally upright manner and having upper and lower ends and front, rear and side walls, said housing also having means for generating a zone of reduced pressure therein, floor nozzle means carried at the lower end of said housing, conduit means connecting said floor nozzle means with said reduced pressure zone, elongated handle means connected to said housing, said handle means facilitating manipulation of said floor nozzle means over a rug or carpet to be cleaned, a portion of a wall of said housing being inwardly displaced to define an elongated cavity therein, said housing cavity being adapted to receive and retain an elongated, tubular cleaning tool adapted for above-the-floor cleaning, and said handle means extending into said inwardly displaced portion of said housing and defining the outer boundary of said tool cavity.

25. The suction cleaner of claim 24, in which said inwardly displaced portion of said housing is located in the rear wall thereof.

26. The suction cleaner of claim 25, in which said handle means has front and rear sides and is generally U-shaped in cross section, said U-shaped cross section defining a recess in said handle means extending lengthwise thereof, said recess being sized to receive a length of suction hose associated with above-the-floor cleaning, and said handle means is oriented so that said recess is located in the rear side thereof.

27. The suction cleaner of claim 26, in which said housing has an auxiliary inlet located at the lower end of said recess in said handle means, said auxiliary inlet communicates with said reduced pressure zone, one end of said suction hose is connected to said auxiliary inlet and the opposite end of said suction hose is provided with hand nozzle means to facilitate above-the-floor cleaning.

28. The suction cleaner of claim 27, in which said handle means and said hand nozzle means include coacting means operable to provide a force tending to collapse said hose and retain the latter and said hand nozzle means in said recess in said handle means when said cleaner is operating and suction is present at said auxiliary inlet.

29. The suction cleaner of claim 27, in which said elongated, tubular cleaning tool comprises a wand, and one end of said wand is insertable into said hand nozzle means to extend the above-the-floor cleaning capability of said cleaner.

30. The suction cleaner of claim 1, in which said magnetic means comprises at least one elongated strip of magnetic material secured in said recess.

31. The suction cleaner of claim 30, in which said recess has opposed inner surfaces, a pair of said elongated strips of magnetic material is positioned in said recess, each of said strips being secured to a respective one of the opposed inner surfaces of said recess, and the lateral spacing of said strips being such that said strips engage and exert a frictional retaining force on said hose when the latter is positioned in said recess.

32. The suction cleaner of claim 1, in which said handle means and the other end of said hose includes coacting means providing a suction generating force tending to hold said hose in said recess when said suction-generating means is providing suction at said auxiliary inlet.

33. The suction cleaner of claim 32, in which said coacting means comprises a sealing surface on said handle means and a mating surface on said other end of said hose.

34. The suction cleaner of claim 33, in which at least one of said sealing and mating surfaces is inclined with respect to the axis of said hose, said inclination contributing to the retention of said hose in said recess by said suction generated force.

* * * * *